United States Patent [19]

Culmer

[11] 4,163,188

[45] Jul. 31, 1979

[54] SYSTEM FOR ESTABLISHING AND STEERING A PRECISE CURRENT

[75] Inventor: Daniel D. Culmer, Sunnyvale, Calif.

[73] Assignee: National Semiconductor Corporation, Santa Clara, Calif.

[21] Appl. No.: 910,508

[22] Filed: May 30, 1978

[51] Int. Cl.[2] ..... G05F 1/56

[52] U.S. Cl. ..... 323/4; 323/22 R; 323/23

[58] Field of Search ..... 307/296 R, 297, 304; 323/1, 4, 22 R, 23, 25

[56] References Cited

U.S. PATENT DOCUMENTS

| | | | |
|---|---|---|---|
| 3,873,905 | 3/1975 | Marek | 323/25 X |
| 3,899,692 | 8/1975 | Caswell | 323/4 X |
| 4,051,428 | 9/1977 | Imai | 323/4 |

*Primary Examiner*—A. D. Pellinen

*Attorney, Agent, or Firm*—Brown & Martin

[57] ABSTRACT

A system for establishing a precise reference current and steering the precise reference current through a load. A reference resistance is connected between a first node and a common terminal and a first reference voltage is maintained at the first node to establish a precise current flow through the reference resistance. A capacitance is connected between the source and the gate of a field effect transistor. A first switch is provided for connecting the field effect transistor in series with the reference resistance. A control loop is connected to a second node in the series circuit between the first switch and the field effect transistor and to a second reference voltage terminal. A second switch is provided for connecting the control loop to the gate of the field effect transistor; and a third switch connected to the second node is provided for connecting the field effect transistor in series with a load. When the first and second switches are closed and the third switch is open, the control loop causes the capacitance to be charged until the voltage at the second node matches the second reference voltage to thereby provide a voltage across the gate and source of the field effect transistor for sustaining the flow of the precise current through the reference resistor. When the first and second switches are opened and the third switch is closed, the charge on the capacitance causes the precise current to continue to flow from the field effect transistor and the third switch steers the current through the load.

5 Claims, 2 Drawing Figures

SYSTEM FOR ESTABLISHING AND STEERING A PRECISE CURRENT

BACKGROUND OF THE INVENTION

The present invention generally pertains to current sources for electronic circuits and is particularly directed to a system for establishing a precise reference current and steering the current through a load.

In some electronic circuit applications it is necessary to establish a precise reference current during one interval and then provide the precise reference current to a load during a subsequent interval. For example in an analog-to-digital converter described in a co-pending patent application, Ser. No. 910,506, entitled "Expanded Analog-to-Digital Converter Having One-Half LSB Shift", filed on even date herewith by the inventor herein and Ronald Winston Russell, there is a requirement for a precise reference current source which provides a reference current to a resistance ladder during prescribed intervals. In such an analog-to-digital converter it is preferred to continuously reestablish the precise reference current when such current is not required in the operation of the converter.

SUMMARY OF THE INVENTION

The present invention is a system for establishing a precise reference current and steering the precise reference current through a load. The system includes a first node; a reference resistance connected between the first node and a common terminal; a circuit for maintaining a first reference voltage at the first node to establish a precise current flow through the reference resistance; a field effect transistor having its source connected to a supply voltage terminal; a capacitance connected between the source and the gate of the field effect transistor; a first switch for connecting the field effect transistor in series with the reference resistance; a second node in the series circuit between the first switch and the field effect transistor; a control loop connected to the second node and a second reference voltage terminal; a second switch for connecting the control loop to the gate of the first field effect transistor; and a third switch connected to the second node for connecting the first field effect transistor in series with a load.

When the first and second switches are closed and the third switch is open, the control loop causes the capacitance to be charged until the voltage at the second node matches the second reference voltage to thereby provide a voltage across the gate and source of the first field effect transistor for sustaining the flow of the precise current from the first field effect transistor and through the reference resistor; whereby when the first and second switches are opened and the third switch is closed, the charge on the capacitance causes the precise current to continue to flow from the first field effect transistor and the third switch steers the current through the load.

In the preferred embodiment of the present invention, the control loop includes a first current source for providing a first control current; a second current source connected to the voltage supply terminal for providing a second control current that is approximately half the value of the first control current; a pair of matched transistors of like type having their sources connected in common to the first current source, wherein one transistor of the pair has its drain connected to the supply voltage terminal and its gate connected to the second node, and the other transistor of the pair has its drain connected to the second current source and its gate connected to a second reference voltage terminal.

In this embodiment the second switch is adapted for connecting the drain of the other transistor of the pair of the gate of the field effect transistor. Although the matched pair of identical transistors are field effect transistors in the preferred embodiment, the use of bi-polar transistors for this matched pair is considered to be within the scope of the present invention. In the case of such a substitution the emitter, collector and base of the bi-polar transistors are to be connected in correspondence with the source, drain and gate connections of the field effect transistors respectively.

Additional features of the present invention are described in the description of the preferred embodiment.

DESCRIPTION OF THE PREFERRED EMBODIMENT

Figure 1:
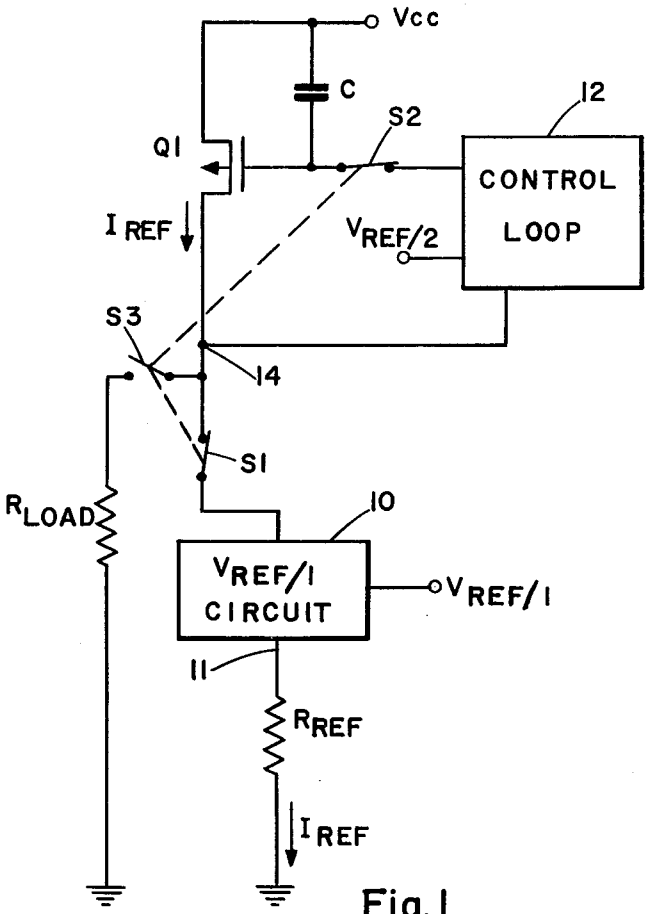
FIG. 1 is a diagram of the system of the present invention.

Referring to FIG. 1, a precise voltage reference circuit 10 maintains a first reference voltage $V_{REF/1}$ at a first node 11. A reference resistance $R_{REF}$ is connected between the first node 11 and circuit ground, whereby a precise reference current $I_{REF}=V_{REF/1}\div R_{REF}$ is established through the reference resistance $R_{REF}$.

A field effect transistor Q1 has its source connected to a voltage supply terminal $V_{cc}$. A capacitance C is connected between the source and the gate of the field effect transistor Q1.

A first switch S1 is provided for connecting the field effect transistor Q1 in series with the reference resistance $R_{REF}$.

A control loop 12 is connected to a second node 14 in the series circuit between the first switch S1 and the field effect transistor Q1. The control loop also is connected to a second reference voltage terminal $V_{REF/2}$ and to a second switch S2. The second switch is provided for connecting the control loop 12 to the gate of the field effect transistor Q1.

A third switch S3 is connected to the second node 14 for connecting the field effect transistor Q1 in series with a load $R_{LOAD}$.

When the first switch S1 and the second switch S2 are closed and the third switch S3 is open, as shown in FIG. 1, the control loop 12 causes the capacitance C to be charged until the voltage at the second node 14 matches the second reference voltage $V_{REF/2}$, to thereby provide a voltage across the gate and source of the field effect transistor Q1 for sustaining the flow of the precise current $I_{REF}$ from the field effect transistor Q1 and through the reference resistor $R_{REF}$.

When the first switch S1 and the second switch S2 are opened and the third switch S3 is closed, the charge on the capacitance C causes the precise current $I_{REF}$ to continue to flow from the field effect transistor Q1 and the third switch S3 steers the precise current $I_{REF}$ through the load $R_{LOAD}$.

Figure 2:
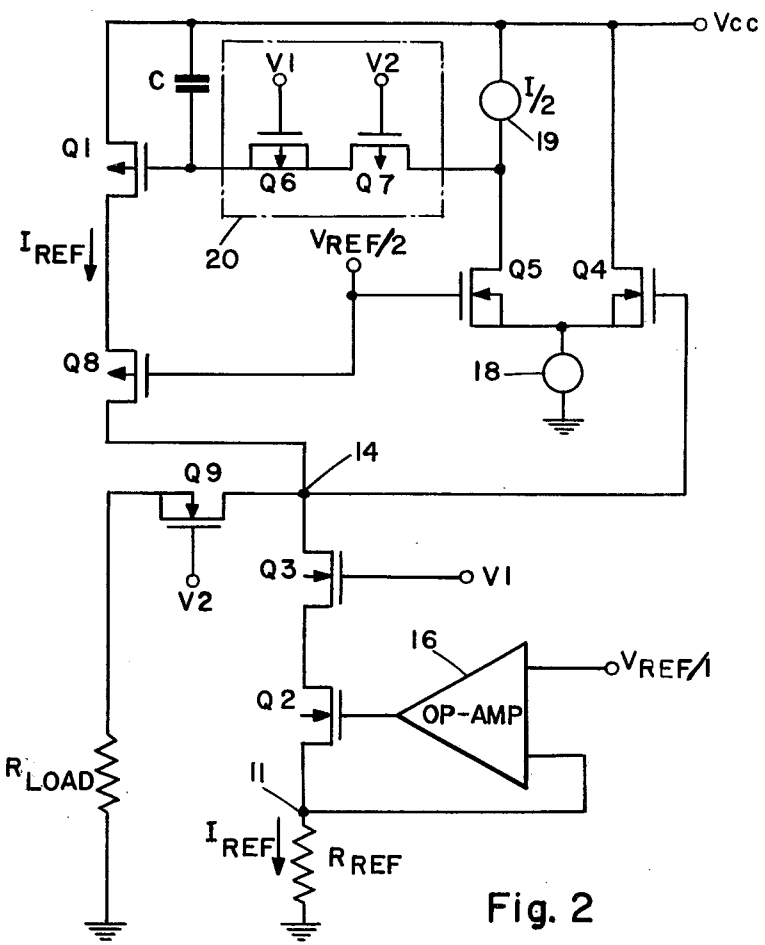
FIG. 2 is a schematic circuit diagram of a preferred embodiment of the system of the present invention.

A schematic circuit diagram of the system of the present invention is shown in FIG. 2.

A first reference voltage $V_{REF/1}$ is maintained at a first node 11 by a circuit including an operational amplifier 16 and a MOSFET (metal-oxide-semiconductor field effect transistor) Q2. The MOSFET Q2 provides a low impedance path between the output of the operational amplifier and the first node 11.

A reference resistance $R_{REF}$ is connected between the first node 11 and circuit ground, whereby a precise reference current $I_{REF}=V_{REF/1}\div R_{REF}$ is established through the reference resistance $R_{REF}$.

A MOSFET Q1 has its source connected to a voltage supply terminal $V_{cc}$. A capacitance C is connected between the source and the gate of the MOSFET Q1.

A first MOSFET switching device Q3 is provided for connecting the MOSFET Q1 in series with the reference resistance $R_{REF}$. The MOSFET Q2 serves as a high impedance buffer between the first node 11 and the first MOSFET switching device Q3.

A second node 14 is included in the series circuit between the MOSFET Q1 and the first MOSFET switching device Q3.

In the system of FIG. 2, the control loop discussed hereinabove includes a first current source 18, a second current source 19, and a pair of matched MOSFET's of like type Q4 and Q5.

The first current source 18 provides a first control current I. The second current source 19 is connected to the voltage supply terminal $V_{cc}$ for providing a second control current I/2 that is approximately half the value of the first control current I. The pair of matched MOSFET's have their sources connected in common to the first current source 18, wherein the MOSFET Q4 has its drain connected to the supply voltage terminal $V_{cc}$ and its gate connected to the second node 14; and the MOSFET Q5 has its drain connected to the second current source 19 and its gate connected to a second reference voltage terminal $V_{REF/2}$.

A second MOSFET switching device 20 is provided for connecting the drain of the MOSFET Q5 to the gate of the MOSFET Q1. The second MOSFET switching device 20 includes two MOSFET's Q6 and Q7. The MOSFET Q6 has its source and drain connected together to the drain of the MOSFET Q7 to cancel charge injected at the gate of the MOSFET Q7 to thereby prevent such charge from bleeding off to the capacitance C. The charge cancellation feature of this second MOSFET switching device 20 is the subject of a separate patent application by the inventor herein entitled "MOSFET Switching Device With Charge Cancellation", Ser. No. 910,698, filed on even date herewith, the disclosure of which is incorporated herein by reference thereto.

A third MOSFET switching device Q9 is connected to the second node 14 for connecting the field effect transistor Q1 in series with a load $R_{LOAD}$. Complementing control signals V1 and V2 are applied to the gates of the MOSFET's Q3, Q6, Q7 and Q9 to control the conduction states of the three MOSFET switching devices.

When the first and second MOSFET switching devices Q3 and 20 are rendered conductive and the third MOSFET switching device Q9 is nonconductive, the capacitance C is charged until the voltage at the second node 14 matches the second reference voltage $V_{REF/2}$ to thereby provide a voltage across the gate and source of the field effect transistor Q1 for sustaining the flow of the precise current $I_{REF}$ from the field effect transistor Q1 and through the reference resistor $R_{REF}$.

When the first and second MOSFET switching devices Q3 and 20 are rendered nonconductive and the third MOSFET switching device Q9 conducts the charge on the capacitance C causes the precise current $I_{REF}$ to continue to flow from the field effect transistor Q1 and the third MOSFET switching device steers the current $I_{REF}$ through the load $R_{LOAD}$.

A cascode device including a MOSFET Q8 is connected in series between the MOSFET Q1 and the second node 14 for providing a high impedance at the second node 14 to prevent the established precise current flowing from the MOSFET Q1 from changing. The gate of the MOSFET Q8 is connected to the second voltage reference terminal $V_{REF/2}$.

I claim:

1. A system for establishing a precise reference current and steering the precise reference current through a load, comprising a first node;

a reference resistance connected between the first node and a common terminal;

means for maintaining a first reference voltage at the first node to establish a precise current flow through the reference resistance;

a field effect transistor having its source connected to a supply voltage terminal;

a capacitance connected between the source and the gate of the field effect transistor;

a first switch for connecting the field effect transistor in series with the reference resistance;

a second node in the series circuit between the first switch and the field effect transistor;

a control loop connected to the second node and to a second reference voltage terminal;

a second switch for connecting the control loop to the gate of the field effect transistor; and a third switch connected to the second node for connecting the field effect transistor in series with a said load;

wherein when the first and second switches are closed and the third switch is open, the control loop causes the capacitance to be charged until the voltage at the second node matches the second reference voltage to thereby provide a voltage across the gate and source of the field effect transistor for sustaining the flow of the precise current from the field effect transistor and through the reference resistor;

whereby when the first and second switches are opened and the third switch is closed, the charge on the capacitance causes the precise current to continue to flow from the field effect transistor and the third switch steers the current through the load.

2. A system according to claim 1, further comprising a cascode device connected between the second node and the field effect transistor for providing a high impedance at the second node to prevent the established precise current from changing.

3. A system for establishing a precise reference current and steering the precise reference current through a load, comprising a first node;

a reference resistance connected between the first node and a common terminal;

means for maintaining a first reference voltage at the first node to establish a precise current flow through the reference resistance;

a field effect transistor having its source connected to a supply voltage terminal:

a capacitance connected between the source and the gate of the field effect transistor;

a first switch for connecting the field effect transistor in series with the reference resistance;

a second node in the series circuit between the first switch and the field effect transistor;

a first current source for providing a first control current;

a second current source connected to the voltage supply terminal for providing a second control current that is approximately half the value of the first control current;

a pair of matched transistors of like type having their sources connected in common to the first current source, wherein one transistor of the pair has its drain connected to the supply voltage terminal and its gate connected to the second node, and the other transistor of the pair has its drain connected to the second current source and its gate connected to a second reference voltage terminal;

a second switch for connecting the drain of the other transistor of the pair to the gate of the field effect transistor; and a third switch connected to the second node for connecting the field effect transistor in series with a said load;

wherein when the first and second switches are closed and the third switch is open, the capacitance is charged until the voltage at the second node matches the second reference voltage to thereby provide a voltage across the gate and source of the field effect transistor for sustaining the flow of the precise current from the field effect transistor and through the reference resistor;

whereby when the first and second switches are opened and the third switch is closed, the charge on the capacitance causes the precise current to continue to flow from the field effect transistor and the third switch steers the current through the load.

4. A system according to claim 3, further comprising a cascode device connected between the second node and the field effect transistor for providing a high impedance at the second node to prevent the established precise current from changing.

5. A system according to claim 4, wherein the cascode device comprises a second field effect transistor having its source and drain connected in series between the field effect transistor and the second node and its gate connected to the second reference voltage terminal.

* * * * *